United States Patent [19]

Adachi et al.

[11] 4,326,842

[45] Apr. 27, 1982

[54] DEVICE FOR THE PULVERIZATION OF RADIOACTIVE WASTES

[75] Inventors: Toshio Adachi, Nagoya; Susumu Hiratake, Kasugai, both of Japan

[73] Assignee: Daidotokushuko Kabushikikaisha, Japan

[21] Appl. No.: 115,155

[22] Filed: Jan. 24, 1980

[30] Foreign Application Priority Data

Jan. 27, 1979 [JP] Japan ..... 54-8326

[51] Int. Cl.[3] ..... G21F 9/34

[52] U.S. Cl. ..... 425/10; 219/121 PA; 266/901; 422/903; 252/626

[58] Field of Search ..... 252/301.1 W; 75/0.5 B, 75/0.5 C; 266/901; 241/DIG. 38; 425/6, 10; 13/2; 219/121 PA, 121 PB; 422/903

[56] References Cited

U.S. PATENT DOCUMENTS 3,779,182 12/1973 Camacho ..... 219/121 PB
3,894,573 7/1975 Paton ..... 13/2 P

FOREIGN PATENT DOCUMENTS 905170 7/1972 Canada ..... 75/0.5 B
54-126900 10/1979 Japan ..... 252/301.1 W

*Primary Examiner*—Deborah L. Kyle
*Attorney, Agent, or Firm*—William A. Drucker

[57] ABSTRACT

A device for pulverizing incombustible large solid radioactive wastes arising from atomic power plants or the like. The device comprises a furnace body provided with a vacant space for melting radioactive wastes, a gripper mounted on the furnace body to support the radioactive waste, plasma torches mounted on the furnace body to irradiate a plasma arc toward the lower end of the wastes, and a water vessel disposed below the vacant space.

8 Claims, 4 Drawing Figures

DEVICE FOR THE PULVERIZATION OF RADIOACTIVE WASTES

BACKGROUND OF THE INVENTION

1. Field of the Invention

This invention relates to a device for pulverizing radioactive wastes, particularly, miscellaneous incombustible large solid wastes, arising from atomic power plants or other establishments for handling radioactive materials.

2. Description of the Prior Art

It is difficult to handle the radioactive wastes as described above because of their large size.

In order to facilitate the handling of such wastes, the present inventor has conceived a device as described below, that is, a device of the construction in which the radioactive wastes are heated so as to become molten by means of a heater within a crucible, the crucible is then tilted to let a melt flow down, the flowing down melt is blown into fine pieces by air injected from a nozzle, and said fine pieces fall into water to obtain pulverized material.

However, the aforesaid device involves a huge cost in installation because of its complicated construction. The device also involves a high degree of maintenance during the use. In addition, because of the construction as mentioned above, it requires a long period of time to place the device in normal state from commencement of operation. Moreover, when an attempt is made to close the operation, all the wastes currently charged into the crucible must be treated. This results in a limitation in starting and stopping the process.

SUMMARY OF THE INVENTION

It is an object of the present invention to provide a device which can pulverize a bulky radioactive waste to a smaller size.

The radioactive wastes pulverized as described above are later easily handled in the event that they must be stored to wait for radioactivity to diminish, for example, the wastes may be filled into a storing container in a simple manner.

Further, in the event that light-weight wastes or various incinerated ashes are dumped in the sea, the pulverized wastes can be re-used as a weight-increasing material used to increase the weight of such wastes or ashes to be dumped.

It is a further object of the present invention to provide a device which has a useful function as described above and yet can be installed at lower cost.

That is, the present invention provides a simple arrangement wherein the radioactive wastes are heated so as to become molten and form a melt by plasma arcs emitted from a plasma torch, and said melt in the drop form is dropped into the water to obtain pulverized particles. Such a simple device can be installed at a small cost.

It is another object of the present invention to provide a device in which maintenance therefor to be accomplished at the time of operation is simplified.

It is a still another object of the present invention to provide a device with which the pulverizing operation can be readily started and stopped.

That is, in the device of the present invention, the radioactive wastes are heated by the plasma arc so as to become molten, immediately thereafter the melt is dropped into water, whereby dropping can commence immediately after heating has commenced. In addition, the thus molten wastes are dropped as soon as produced and so, the operation can be stopped at any time.

Other objects and advantages of the invention will become apparent during the following discussion of the accompanying drawings.

DESCRIPTION OF THE PREFERRED EMBODIMENTS

Figure 1:
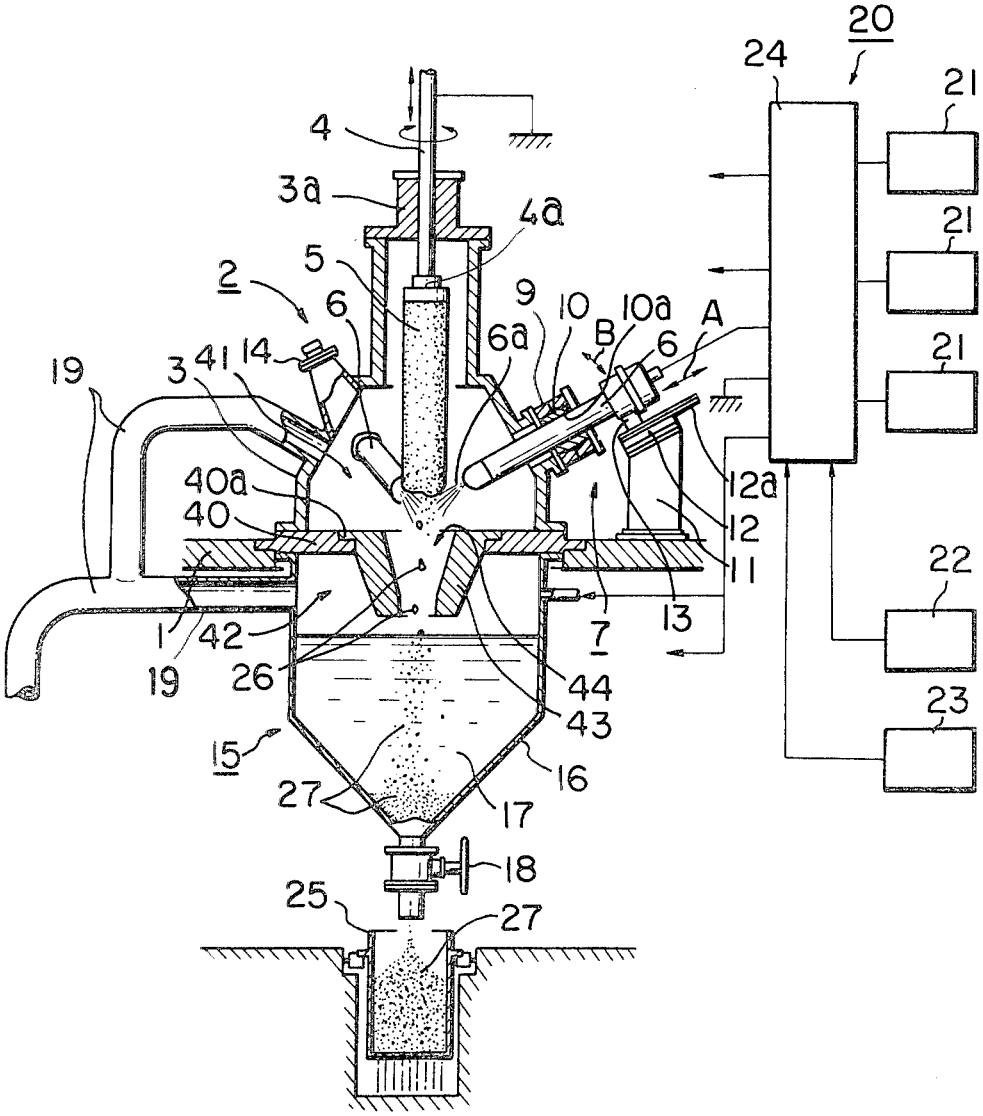
FIG. 1 is a longitudinal sectional view of the device for pulverization showing a plasma torch control circuit in block form.

In FIG. 1, a melting device 2 is constructed above a base board 1. The melting device 2 has a water-cooled furnace body 3. The furnace body 3 defines a space for melting the radioactive wastes. A furnace cover 3*a* is removably attached to the top of the furnace body 3. Bolts and nuts or clamps may be used as means for removably mounting the cover. A gripper 4 is mounted on the furnace cover 3*a* so as to be rotatable and movable up and down. The gripper 4 is rotated about its axis and moved up and down by an operating mechanism not shown. A connector 4*a* is threadedly mounted on the lower end of the gripper 4. A portion 5 of radioactive waste 5 is connected in a suspended fashion to the connector 4*a*. The waste portion includes metals (such as pipes, valves, plates, die steels, and tools), waste filters (such as prefilters, HEPA filters) and inorganic materials (such as heat insulating material, fire-resisting material, glasses and concrete). It will be observed that the portions 5 of radioactive waste are contaminated by radioactivity such that as shown in FIG. 2 (A), wherein the radioactive nuclides 5*b* are adhered to the surface of a solid 5*a* which forms the pipe, filter, glass and the like as described above, which is well-known. Connection means of the waste portion 5 to the connector 4*a* may be a bolt and nut. It will be noted that if the waste portions 5 are metal, welding may also be used for that purpose.

Plasma torches 6 are mounted on the side walls of the furnace body 3. In the illustrated embodiment, three such plasma torches 6 are spaced by 120° and are each supported retractably and tiltably by a support mechanism 7. The support mechanism 7 has a support frame 9 secured to the furnace body 3. The interior of the support frame 9 comprises a spherical surface. A spherical body 10 is fitted internally of the support frame 9. Externally the spherical body 10 comprises a spherical surface capable of frictional sliding movement with respect to the internal surface of the support frame 9. The spherical body 10 has a through-hole 10*a* bored therein. The aforesaid plasma torch 6 is retractably inserted into the through-hole 10*a*. The support device 7 further has a retracting device 12 for retracting the plasma torch 6. The retracting device 12 is mounted on the frame 11 secured to the base board 1 and has its retracting portion 12*a* which retracts in a direction as indicated by the arrow A. The retracting portion 12*a* has a tilting device 13 mounted thereon. The tilting device 13 comprises, for example, a hydraulic cylinder, to tilt the plasma torch 6 in a direction as indicated by the arrow B.

The furnace body 3 has a peep window 14.

Next, a water treatment means 15 is positioned under the base board 1. This water treatment means 15 is positioned directly beneath the melting device 2. The water treatment means 15 has a water vessel 16 filled with water 17. The water vessel 16 is provided at its lower end with a discharge opening adapted to be opened and closed by a valve 18. Next, the upper portion of the water vessel 16 is closely connected to the lower portion of the furnace body 3, and a shielding wall 40 is disposed between the furnace body 3 and the water vessel 16. This wall 40 is provided to thermally shield a space 41 internally of the furnace body 3 and a space 42 internally of the water vessel 16. Preferably, the wall 40 may be of water-cooled construction similar to the furnace body 3. The shielding wall 40 has a hole formed in the central portion thereof. On the edge 40*a* of the hole is mounted a cylindrical depending wall 43 suspended from the shielding wall 40. The interior of the hanging wall 43 has a through-hole 44, through which drops 26 later described will drop. A gas discharging duct 19 is connected to the furnace body 3 of the melting device 2 and to the water vessel 16 of the water treatment means 15.

Reference numeral 20 designates a control mechanism. The control mechanism 20 comprises a power source device 21, a gas supply device 22, a water supply device 23 and a control device 24. The power source device 21 is provided for use with each of the plasma torches 6. For the power source device 21, a DC power source device can be used and also, an AC power source device can be used depending upon the plasma torch to be used. As power supply systems to the plasma torches 6, a transfer system or a non-transfer system may be used in accordance with kind of the wastes 5. That is, the transfer system may be employed if the wastes are metal, and the non-transfer system may be employed if the wastes are mainly non-metal.

The gas supply device 22 is provided to supply gases to form a plasma by means of the plasma torch 6. The gases used include inert gases such as argon and other gases such as nitrogen.

The water supply device 23 is provided to supply cooling water for the torches 6 and furnace body 3 and water for the water treatment means 15.

The control device 24 is designed in a known manner so as to adequately control a supply of electricity, gas and water to the torches 6, the furnace body 3 and the water treatment means 15.

The operation of the above-mentioned device will be described hereinafter.

First, the portion 5 of waste is attached to the gripper 4 with the furnace cover 3*a* removed from the furnace body 3. This attachment may be achieved by bringing the connector 4*a* pre-secured to the portion 5 of waste into threadable engagement with the lower end of the gripper 4. Next, the furnace cover 3*a* is mounted on the furnace body 3 and the portion 5 of waste is positioned to assume the position as shown. Then, the plasma torches 6 are operated to emit the plasma arcs 6*a* by which the portion 5 of waste may be heated so as to become molten. The portion 5 of waste is moved up and down in a direction as indicated by the arrow or is rotated and or the plasma torches 6 are retracted in a direction as indicated by the arrow A or tilted in a direction as indicated by the arrow B so that the waste 5 is melted in orderly fashion from the lower end thereof.

During the above-mentioned melting step, the waste gases taken out of the plasma torches 6 in the form of plasma and used up to heat the portion 5 of waste are principally discharged via the duct 19 in communication with the space 41 internally of the furnace body 3. However, the exhaust gases partly enter the space 42 from the space 41 by passing through the through-hole 44 and are discharged through the duct 19 in communication with the space 42.

When the portion 5 of waste is melted in the manner as described above, the melt falls in the form of a drop 26. The drops 26 fall directly into water 17 within the water vessel 16 for pulverization and cooling into pulverized particles 27 which are deposited on the bottom of the water vessel 16. In the event that the hot melt drops 26 falling into water 17 as described above produces vapor, the vapor principally stays in the space 42 and is discharged through the duct 19 in communication with the space 42.

The thus formed pulverized particles 27 are passed into the container 25 together with water 17 by opening the valve 18. The container 25 is formed at its bottom with a water drainage hole so that only the pulverized particles 27 remain within the container 25 and water 17 is discharged. The pulverized particles 27 taken into the container 25 are dried by means of a drying agent or by natural ventilation. The dried pulverized particles 27 are introduced into a storing container for storage or used as a weight-increasing material.

After all the portions 5 of waste have been melted by the operation as described above, the cover 3*a* is again removed from the furnace body 3 and the connector 4*a* is removed from the gripper 4. Thereafter, a fresh portion of waste is attached in a manner similar to the former case, and the similar operation is repeated.

The pulverized particle 27 produced in the manner as described above has the following dimensions and contents for example.

Where the waste is metal, the pulverized particles 27 are about 2 mm to 10 mm in diameter. It is estimated that those of 5 to 10 mm are about 90%, those of 2 mm are about one percent and those of other diameters are about 9%.

Where the waste is non-metal, the pulverized particles 27 are about 0.5 to 8 mm. In the percentage, it is estimated that those of 5 to 8 mm are about 7%, those of 2 to 5 mm are about 70%, those of 0.5 to 2 mm are about 18%, and those of other diameters are about 5%.

It is a matter of course that the size or diameter and the percentage contents of the pulverized particles 27 vary with the size and shape of the portions of waste to be melted, the injection speed of the plasma arc, the degree of agitation of water 17 within the water vessel 16, the amount or size of the drops 26 falling into the water at a time, the temperature of the plasma arc, the temperature of water 17, and the like.

Figure 2A:
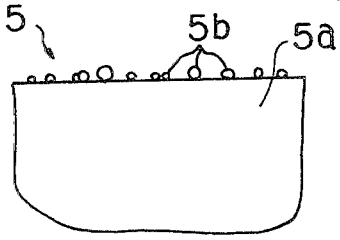
FIGS. 2(A) and (B) are longitudinal sectional views of radioactive wastes.
Figure 2B:
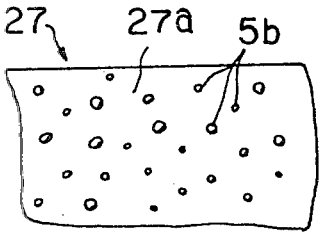

It should be noted that the pulverized particles 27 produced as described above have been subjected to the melting operation as mentioned above, and thus the radioactive nuclides 5*b* adhered to the surface of the solid material 5*a* as shown in FIG. 2(A) are buried and mixed into the solid material, and the nuclides 5*b* in the resolidified state become incorporated into the once molten and solidified solid material 27*a* as shown in FIG. 2(B). Accordingly, the radioactive rays radiated from the nuclides 5*b* are partly intercepted by the solid material 27*a*, and hence, the quantity of radioactive rays emerging externally of the pulverized particles 27 decreases.

Figure 3:
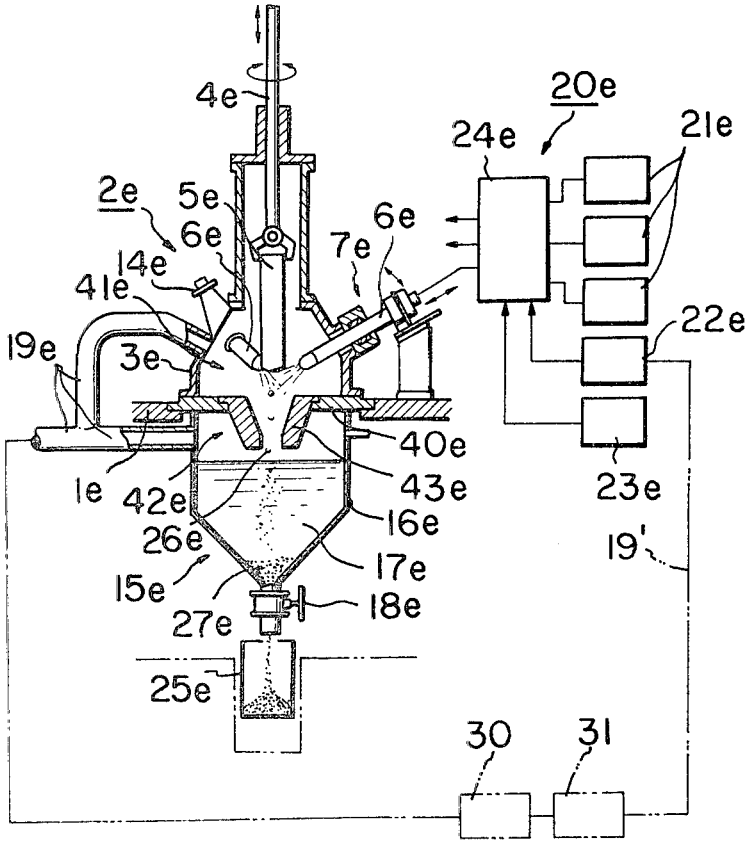
FIG. 3 illustrates a device similar to that of FIG. 1 but in a different form of embodiment.

Next, FIG. 3 shows a different mode of embodiment. The device shown in FIG. 3 comprises a cooler 30 and a compressor 31 in communication with the cooler 30. The cooler 30 is placed in communication with a space 41*e* internally of the furnace body 3*e* and with a space 42*e* internally of a water vessel 16*e*, through a duct 19*e* illustrated as a gas flow passage. The compressor 31 is placed in communication with plasma torches 6*e* through a gas flow passage. The gas from the duct 19*e* is cooled and pressurized, after which it is supplied to the plasma torches.

The flow passage positioned between the compressor 31 and the plasma torch 6*e* includes a duct 19', a gas supply device 22*e* and a control device 24*e*.

When vapor within the gases is condensed into water as the gas is cooled by the cooler 30, the water may be thrown away but it may sometimes be returned to the water supply device 23*e* for reuse. Further, in come applications there is disposed a filter, between the cooler 30 and the compressor 31, to collect dust raised when the wastes are molten.

In the case of such an arrangement as described above, it is advantageous in that the gases used to heat and melt the radioactive wastes and thus contaminated by radioactivity are not released outside.

In the present embodiment, those parts considered identical or equivalent in function to those in the previous embodiments bear like reference numerals with 'e' affixed thereto for omission of repeated explanation.

As many apparently widely different embodiments of this invention may be made without departing from the spirit and scope thereof, it is to be understood that the invention is not limited to the specific embodiments thereof except as defined in the appended claims.

We claim:

1. A pulverising device comprising:

(i) a hollow furnace body defining a space for the melting of a portion of radioactive waste, (ii) a gripper mounted on said furnace body and adapted to support a portion of radioactive waste in said space in said furnace body, (iii) plasma torch means mounted on said furnace body and directed to irradiate a plasma arc toward a lower end of said portion of radio-active waste supported by said gripper, and (iv) a water vessel disposed below said space for storage of water, whereby said portion of radio-active waste is heated so as to be melted within said space by said plasma arc, and the molten waste falls as a succession of drops into said water and becomes pulverised.

2. The device as defined in claim 1 wherein said gripper is mounted on an upper portion of said furnace body and is movable up and down and is rotatable about a vertical axis.

3. The device as defined in claim 1 or claim 2 further comprising a mechanism for supporting said plasma torch means on said furnace body, said mechanism having means for tiltably and retractably mounting said plasma torch means on said furnace body.

4. The device, as defined in claim 1 further comprising means defining a gas flow passage in communication with said space for discharging gas therefrom, a cooler in communication with said flow passage for cooling gases discharged through said passage, a compressor in communication with said cooler for compressing gases cooled by said cooler, and means defining a further gas flow passage between said compressor and said plasma torch means for returning gases compressed by said compressor to said plasma torch means.

5. The device, as defined in claim 1, wherein a lower portion of said furnace body and an upper portion of said water vessel are connected, and a shielding wall is positioned between said furnace body and said water vessel to thermally shield said space in said furnace body from a second space in said water vessel, said shielding wall being formed with a through-hole through which drops of said molten waste may pass.

6. The device, as defined in claim 5 further comprising means connected to said furnace body and to said water vessel and defining a first gas flow passage communicating with said space in said furnace body and a second gas flow passage communicating with said second space for discharge of gases from said spaces, a cooler in communication with said gas flow passages for cooling gases discharged through said flow passages, a compressor in communication with said cooler for compressing gases cooled by said cooler, and means defining a further gas flow passage between said compressor and said plasma torch means for returning gases compressed by said compressor to said plasma torch means.

7. The device as defined in claim 5 or claim 6 comprising a wall depending from said shielding wall, said depending wall being tubular and having an upper end the entire periphery of which is joined to an entire periphery of said shielding wall bounding said through-hole.

8. The device as defined in claim 7 wherein said gripper is mounted on said upper portion of said furnace body, said gripper being movable up and down and being rotatable about a vertical axis, said plasma torch means being supported by a support mechanism comprising respective means mounting said plasma torch means tiltably and retractably on said furnace body.

* * * * *